US005916007A

United States Patent [19]

Maxim

[11] Patent Number: 5,916,007

[45] Date of Patent: Jun. 29, 1999

[54] MAGNETICALLY TRIPPED SPRING WOUND VEHICLES

[76] Inventor: John G. Maxim, 863 Coventry St., Boca Raton, Fla. 33487

[21] Appl. No.: 08/889,457

[22] Filed: Jul. 8, 1997

[51] Int. Cl.[6] ..... A63H 29/24

[52] U.S. Cl. ..... 446/130; 446/460; 446/461; 446/464

[58] Field of Search ..... 446/129, 130, 446/132, 133, 436, 460, 461, 463, 464, 437, 458, 459

[56] References Cited

U.S. PATENT DOCUMENTS

| | | | |
|---|---|---|---|
| 2,832,177 | 4/1958 | Mueller | 446/457 |
| 3,387,404 | 6/1968 | Appel . | |
| 3,471,963 | 10/1969 | Tomiyama . | |
| 3,665,643 | 5/1972 | Colgrove | 446/457 |
| 3,748,780 | 7/1973 | Glass et al. | 446/464 |
| 3,867,786 | 2/1975 | Greenbelt | 446/130 |
| 4,329,810 | 5/1982 | Terui | 446/457 |
| 4,467,557 | 8/1984 | Kuna et al. | 446/463 |
| 4,516,954 | 5/1985 | Chow et al. | 446/461 |
| 4,519,789 | 5/1985 | Halford et al. | 446/461 |
| 4,536,169 | 8/1985 | Fekete et al. | 446/461 |
| 4,541,815 | 9/1985 | Lee et al. | 446/464 |
| 4,556,397 | 12/1985 | Arad et al. | 446/436 |
| 4,580,994 | 4/1986 | Fauser et al. | 446/461 |
| 4,582,171 | 4/1986 | Jezierski | 185/39 |
| 4,684,354 | 8/1987 | Orenstein | 446/130 |
| 4,741,418 | 5/1988 | Kaiser | 191/10 |
| 5,112,267 | 5/1992 | Liu et al. | 446/457 |
| 5,195,920 | 3/1993 | Collier | 446/409 |
| 5,273,478 | 12/1993 | Yamasaki | 446/463 |
| 5,306,197 | 4/1994 | Watanabe | 446/409 |
| 5,352,147 | 10/1994 | Nagel et al. | 446/409 |

FOREIGN PATENT DOCUMENTS

| | | | |
|---|---|---|---|
| 2211468 | 9/1973 | Germany | 446/130 |
| 373910 | 12/1939 | Italy | 446/461 |
| 1465699 | 2/1977 | United Kingdom | 446/133 |
| 2089224 | 6/1982 | United Kingdom | 446/133 |

*Primary Examiner*—Robert A. Hafer
*Assistant Examiner*—Jeffrey D. Carlson
*Attorney, Agent, or Firm*—Oltman, Flynn & Kubler

[57] ABSTRACT

An entertainment apparatus includes a chassis, support wheels rotatably secured to the chassis, a back-wind spring powered motor mounted to the chassis and drivably connected to at least one of the support wheels, so that the motor is wound by rolling the chassis backward on the support wheels, and a locking mechanism including a structure for releasibly locking the motor against unwinding and a structure for releasing the motor to deliver torque to and thereby rotate the at least one support wheel and accelerate the apparatus across a support surface. The locking mechanism includes a fulcrum structure secured to the chassis and having a fulcrum pivot connection member, a lever structure pivotally connected to the pivot connection member and having a lever magnet secured to the lever structure a certain distance from the fulcrum pivot connection member, and connected to the locking mechanism so that pivoting the lever structure on the fulcrum pivot connection member in a first direction causes the motor locking mechanism to release and thereby actuate the motor, and pivoting the lever structure on the fulcrum pivot connection member in a second direction causes the motor locking mechanism to lock the motor against actuation, and an actuating magnet to be hand oriented by the user relative to the lever magnet so that the field of the actuating magnet repels the field of the lever magnet and thereby pivots the lever structure in the first direction to actuate the motor when placed close to the lever magnet.

2 Claims, 3 Drawing Sheets

MAGNETICALLY TRIPPED SPRING WOUND VEHICLES

BACKGROUND OF THE INVENTION

1. Field of the Invention

The present invention relates generally to the field of toys and novelty items including scale models and miniatures of larger items. More specifically the present invention relates to a stylized miniature entertainment apparatus in the form of an automobile or character including a chassis with support wheels, a hollow shell body and a back-wind spring powered motor of conventional design. The motor is wound by rolling the chassis backward on its support wheels, and is retained in a wound condition and activated at a selected time with a mechanical locking mechanism which is magnetically tripped to deliver torque to the support wheels and accelerate the apparatus across a support surface.

The locking mechanism includes a motor trip lever structure with a lever magnet on at least one lever structure end and a separate motor actuating magnet. The locking mechanism is operated by placing the actuating magnet near the at least one lever structure end so that the field of the actuating magnet repels the field of the lever magnet and pivots the lever structure end away from the actuating magnet to actuate the motor. The actuating and lever magnets are oriented relative to each other such that either two magnetic north poles oppose each other or two magnetic south poles oppose each other.

Where the apparatus body is styled as a miniature automobile, a simulated miniature gasoline can with a pouring spout is provided and the motor actuating magnet is secured to the pouring spout free end. The lever end and lever magnet are preferably located on the automobile adjacent to a representation of a gasoline cap on the body, so that moving the actuating magnet progressively nearer to the lever magnet to actuate the motor creates the illusion of pouring gasoline into the automobile to power its subsequent acceleration.

Another feature of the invention is a direction-biasing weight taking the form of a disproportionately large gear shift ball on a shift lever extending through a slot pattern in the body roof. The gear shift ball controls the apparatus rolling direction and attitude, by shifting the apparatus center of gravity and by producing drag during acceleration and momentum during deceleration. The apparatus body is alternatively styled as a character such as an animal or a person, having the lever magnet positioned near the character mouth and the actuating magnet secured to a simulated, miniature feeding bowl or bottle.

2. Description of the Prior Art

There have long been toy automobiles and other miniaturized entertainment devices for people of all ages, and most commonly children. These prior devices generally have been convincing except for the appearance and operation of their motor tripping and actuating mechanisms. These prior mechanisms have generally been triggered in ways inconsistent with operation of an actual automobile or other real life counterpart, diminishing the entertaining illusion. Furthermore, some prior devices have included direction and deceleration control mechanisms, but these generally have been difficult to operate.

Lee, et al., U.S. Pat. No. 4,541,815, issued on Sep. 17, 1985, and Chow, et al., U.S. Pat. No. 4,516,954, issued on May 14, 1985, having common inventors, both teach essentially the same toy vehicle. This vehicle is rolled backward to store energy and it includes a frame fitted with a combined gear box and spring motor and a toggle-linkage system connected to the frame. As the vehicle is rolled backward and the motor spring is wound, the toggle-linkage system is urged by the increasing spring tension to a certain position over center, which locks the gear box to retain the energy stored in the wound spring. Pressing the toggle-linkage system downwardly moves it into another position over center which unlocks the gear box and releases the energy stored in the wound spring, thereby propelling the vehicle. To move the toggle-linkage system to unlock the gear box, the user presses down on the slightly open, simulated vehicle hood which includes a downwardly projecting post member. Closing the hood depresses the post member and releases a pinion gear in the gear box. A problem with this vehicle is that no one starts an actual automobile by pushing down on its hood, and a further problem is that the pressure of the user fingers on the hood inhibits a fast start.

Appel, U.S. Pat. No. 3,387,404, issued on Jun. 11, 1968, discloses a toy gasoline pump. Appel includes an outer shell having the shape and appearance of a miniature gasoline pump, having a display window containing rotatable number wheels and a simulated nozzle on a flexible line. A motor within the shell is electrically connected to a power source and drivably connected to the number wheels, and is actuated through a switch located in the nozzle. The nozzle contains a permanent magnet which releasibly connects the nozzle to most metal toy cars, and firm contact with the toy car triggers the switch to actuate the motor. As a result the illusion of pumping gasoline is created. A problem with Appel is that, while the concept is imaginative, the fueled toy car does nothing more than a non-fueled toy car, and thus potential entertainment value is lost.

Eijiro Tomiyama, U.S. Pat. No. 3,471,963, issued on Oct. 14, 1969, reveals a toy automobile and a separate starting device. The Tomiyama toy automobile is powered by what is known as a friction motor, drivably connected to its wheels which, when the motor drive shaft is rotated such as by rolling the car forwardly, tends to retain this rotational speed for an extended time. The Tomiyama starting device includes a platform onto which the toy automobile is placed, and an electric motor for operating drive wheels disposed within an opening in the platform directly under the toy automobile rear wheels. A platform motor triggering mechanism is provided including a pin held within the automobile trunk directly over a switch in the platform. Pushing the pin with an elongated rod throws the switch and actuates the platform motor to rapidly rotate the automobile drive wheels. The rod takes the form of a miniature gasoline pump nozzle. Removal of the nozzle permits the automobile to accelerate off the platform under its own friction motor power. An illusion of fueling the automobile prior to acceleration is created to a certain extent by the nozzle triggering of the motor. A problem with Tomiyama, however, is that the toy automobile gains the illusion benefits only when used in combination with the cumbersome platform structure. Another problem is that contact with the nozzle can inhibit automobile acceleration.

Orenstein, U.S. Pat. No. 4,684,354, issued on Aug. 4, 1987, discloses a finger operated, self-propelled toy. Orenstein includes a battery powered electric motor mounted on a wheeled chassis an actuated through a magnetic reed switch. The user fits an abbreviated glove having an actuating magnet at its tip onto a finger and sweeps the finger and magnet over the reed switch to actuate the electric motor and accelerate the toy. A problem with Orenstein is that the required motion of the actuating magnet relative to the reed switch is a sweeping motion rather than a progressive movement into close proximity, so that the illusion of pouring a fuel or food item is not created. Another problem is that the electric motor requires on-going battery replacement and when combined with a battery becomes relatively bulky, heavy and costly.

Jezierski, U.S. Pat. No. 4,582,171, issued on Apr. 15, 1986, teaches a special effects drive mechanism for self-propelled toy vehicles. Jezierski includes a drive train having a first gear directly rotated by a coiled spring, a second gear coupled in driving engagement with the vehicle wheels, and a third gear shiftable between an engaged position coupling the first and second gears, and a cleared position wherein the second gear can rotate independently of the first gear. The third bear can be locked in its engaged position by a pivotal, gravity biased locking mechanism. This gear drive and locking mechanism is intended to cause the toy to come to an abrupt halt after a powered run and to cause the toy to spin out. A problem with Jezierski is that it is complex and fails to provide means for the more impressive special effects of selecting vehicle direction and producing a wheel stand.

Examples of engine sound emitting toy automobiles are those of Nagel, et al., U.S. Pat. No. 5,352,147, issued on Oct. 4, 1994, teaching a toy vehicle and method of manufacture, which is actuated by pressing a finger against the trunk portion; Watanabe, U.S. Pat. No. 5,306,197, issued on Apr. 26, 1994, for a key action, lever actuated moveable toy automobile, Collier, U.S. Pat. No. 5,195,920, issued on Mar. 23, 1993, for a radio controlled model vehicle having a coordinated sound effects system; and Kaiser, U.S. Pat. No. 4,741,418, issued on May 3, 1988, for an electromagnetic energization system with non-coiled, since wire conductor.

It is thus an object of the present invention to provide a self-propelled entertainment apparatus powered by a back-wind motor which is actuated by bringing an actuating magnet close to a magnet on a motor triggering mechanism, so that no acceleration inhibiting contact with the apparatus takes place.

It is another object of the present invention to provide such an apparatus which is styled as a miniature automobile, animal or person, for which the actuating magnet is connected to a representation of a fuel or food source, to create the illusion of fueling or feeding prior to acceleration.

It is still another object of the present invention to provide such an apparatus which includes a momentum and center of gravity altering mass in a form which may visually simulate a gear shift ball and lever, and which can be re-positioned relative to the apparatus chassis to control acceleration and deceleration directions and to selectively produce a wheel stand during acceleration.

It is finally an object of the present invention to provide such an apparatus which is attractive, sturdy, and reliable and which is relatively inexpensive to manufacture.

SUMMARY OF THE INVENTION

The present invention accomplishes the above-stated objectives, as well as others, as may be determined by a fair reading and interpretation of the entire specification.

An entertainment apparatus is provided, including a chassis, support wheels rotatably secured to the chassis, a back-wind spring powered motor mounted to the chassis and drivably connected to at least one of the support wheels, so that the motor is wound by rolling the chassis backward on the support wheels, and a locking mechanism including a structure for releasibly locking the motor against unwinding and a structure for releasing the motor to deliver torque to and thereby rotate the at least one support wheel and accelerate the apparatus across a support surface.

The locking mechanism includes a fulcrum structure secured to the chassis and having a fulcrum pivot connection member, a lever structure pivotally connected to the pivot connection member and having a lever magnet secured to the lever structure a certain distance from the fulcrum pivot connection member, and connected to the locking mechanism so that pivoting the lever structure on the fulcrum pivot connection member in a first direction causes the motor locking mechanism to release and thereby actuate the motor, and pivoting the lever structure on the fulcrum pivot connection member in a second direction causes the motor locking mechanism to lock the motor against actuation, and an actuating magnet to be hand oriented by the user relative to the lever magnet so that the field of the actuating magnet repels the field of the lever magnet and thereby pivots the lever structure in the first direction to actuate the motor when placed in close proximity to the lever magnet by the user.

The apparatus preferably additionally includes an apparatus body having the configuration of a miniaturized automobile, including a forward engine compartment with a hood, a passenger cab portion and a rearward trunk portion with a representation of a gasoline cap, where the lever magnet is located on the lever structure adjacent to the simulated gasoline cap, and an actuating magnet handle having the configuration of a miniature gasoline can with a can spout, where the actuating magnet is supported by the spout, so that moving the spout of the miniature gasoline can progressively nearer the simulated gasoline cap pivots the lever structure and causes the field of the actuating magnet to repel the field of the lever magnet and thereby pivots the lever structure and actuates the motor to create the illusion of pouring gasoline into the apparatus to power subsequent acceleration of the apparatus.

The apparatus preferably further includes an apparatus body having the configuration of a miniaturized animal, including an animal body and head, where the lever magnet is located on the lever structure adjacent to the head, and an actuating magnet handle having the configuration of a miniature food vessel, where the actuating magnet is connected to the food vessel, so that moving the food vessel progressively nearer the head pivots the lever structure and causes the field of the actuating magnet to repel the field of the lever magnet and thereby pivot lever structure and actuate the motor to create the illusion of feeding the character to power the subsequent run of an animal.

The pivot connection member preferably includes a lever axle extending through the lever structure and through the fulcrum structure, and the lever structure has a side portion on each lateral side of the motor and the side portions are interconnected at lever structure ends by lever end struts, and where one lever magnet is secured to one end strut.

The apparatus preferably additionally includes a decal secured to the lever structure, where the portion of the apparatus body including the representation of a gasoline cap is formed of at least semi-transparent material to reveal the decal when the decal is immediately behind the representation of a gasoline cap, so that the lever structure is positioned to display the decal when the motor spring is wound, and so that pivoting the lever structure to actuate the motor causes the decal to vanish from sight.

The lever structure preferably includes a second lever magnet adjacent to the chassis. The actuating lever structure is optionally connected with linkages to a throttle plate on the apparatus body, and pivoting of the lever structure to actuate the motor opens the throttle plate, and pivoting the lever structure to lock the motor closes the throttle plate.

The gasoline can includes a gasoline can body and the gasoline can body preferably includes flexible walls for squeezing by the user, and the gasoline spout is hollow and in fluid communication with the gasoline can body through a spout connected end and is in fluid communication with the atmosphere through a spout free end, the gasoline can additionally including a plunger, where the actuating magnet is attached to the plunger and the plunger is sealingly and slidably retained within the spout. The gasoline can further includes a coil spring within the spout between the plunger and the spout free end and an inwardly extending annular spout flange at the spout free end, so that the coil spring resiliently bears against the plunger and the annular spout flange, and so that squeezing the can body increases can internal pressure and drives the plunger and plunger magnet toward the spout free end to expose the magnetic field of the plunger magnet to repel the lever magnet, pivot the lever structure and actuate the motor.

The apparatus optionally includes a sound generating mechanism simulating the sound of a revving race car engine and activated and deactivated by the lever structure simultaneously with respective actuation and de-actuation of the motor.

An entertainment apparatus is further provided, including a chassis, support wheels rotatably secured to the chassis, a back-wind spring powered motor mounted to the chassis and drivably connected to at least one support wheel, so that the motor is wound by rolling the chassis backward on the support wheels, and a structure for releasing the motor to deliver torque to and thereby rotate the at least one support wheel and accelerate the apparatus across a support surface, and a direction biasing weight member having a mass secured onto a shift lever.

The apparatus preferably additionally includes an apparatus body having a body roof and a slot pattern in the body roof, the slot pattern including a longitudinal center slot and parallel left and right slots, all interconnected by a lateral slot, so that pushing the shift lever to the front end of the center slot causes the apparatus to accelerate straight forwardly by it placing the mass of the weight member over the longitudinal center of the apparatus and onto the front support wheels, and placement of the weight member over the front the support wheels prevents a wheel stand, and pushing the shift lever to the rear end of the center slot places the mass of the weight member over the longitudinal center of the apparatus and over the apparatus rear support wheels, causing the apparatus to accelerate straight forwardly while tilting backwardly to produce a wheel stand, and so that pushing the shift lever to the front end of the right slot shifts the mass of the weight member to the right side of the apparatus and onto the forward support wheels, so that the apparatus turns to the right as it accelerates forwardly with no wheel stand, and pushing the shift lever to the rear end of the right slot places the mass of the weight member over the longitudinal center of the apparatus and over the apparatus rear support wheels, causing the apparatus to turn to the right as it accelerates forwardly and at the same time to rise into a wheel stand, and pushing the shift lever to the forward end of the left slot shifts the mass of the weight member to the left side of the apparatus, and onto the forward support wheels, so that the apparatus turns to the left as it accelerates with no wheel stand, and pushing the shift lever to the rear end of the left slot causes the apparatus to turn to the left as it accelerates and at the same time to rise into a wheel stand.

BRIEF DESCRIPTION OF THE DRAWINGS

Various other objects, advantages, and features of the invention will become apparent to those skilled in the art from the following discussion taken in conjunction with the following drawings, in which.

DETAILED DESCRIPTION OF THE PREFERRED EMBODIMENTS

Figure 1:
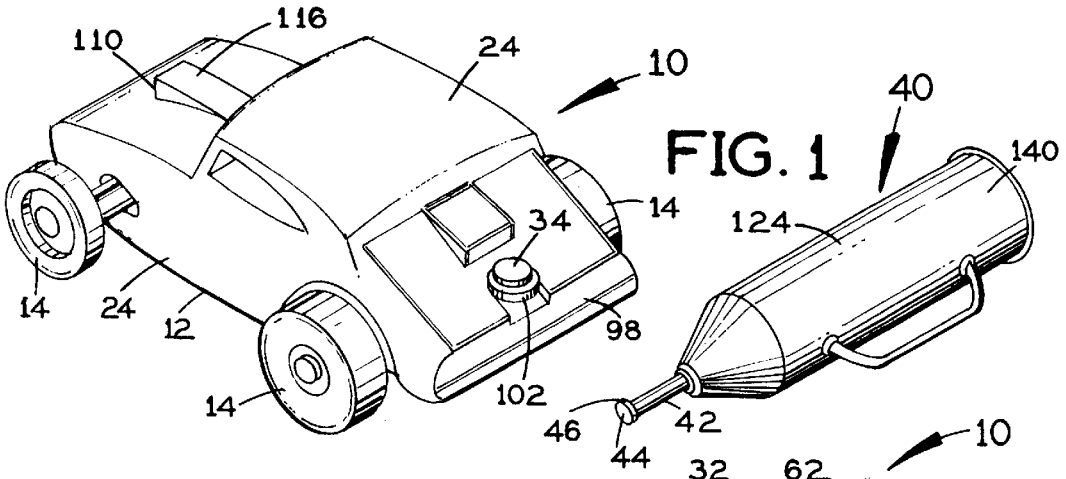
FIG. 1 is a perspective view of a toy automobile embodiment of the apparatus, showing the location of the semi-transparent region of the body containing a representation of a gasoline cap. A preferred miniature gasoline can is also illustrated.

As required, detailed embodiments of the present invention are disclosed herein; however, it is to be understood that the disclosed embodiments are merely exemplary of the invention which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Reference is now made to the drawings, wherein like characteristics and features of the present invention shown in the various FIGURES are designated by the same reference numerals.

Preferred Embodiments

Figure 2:
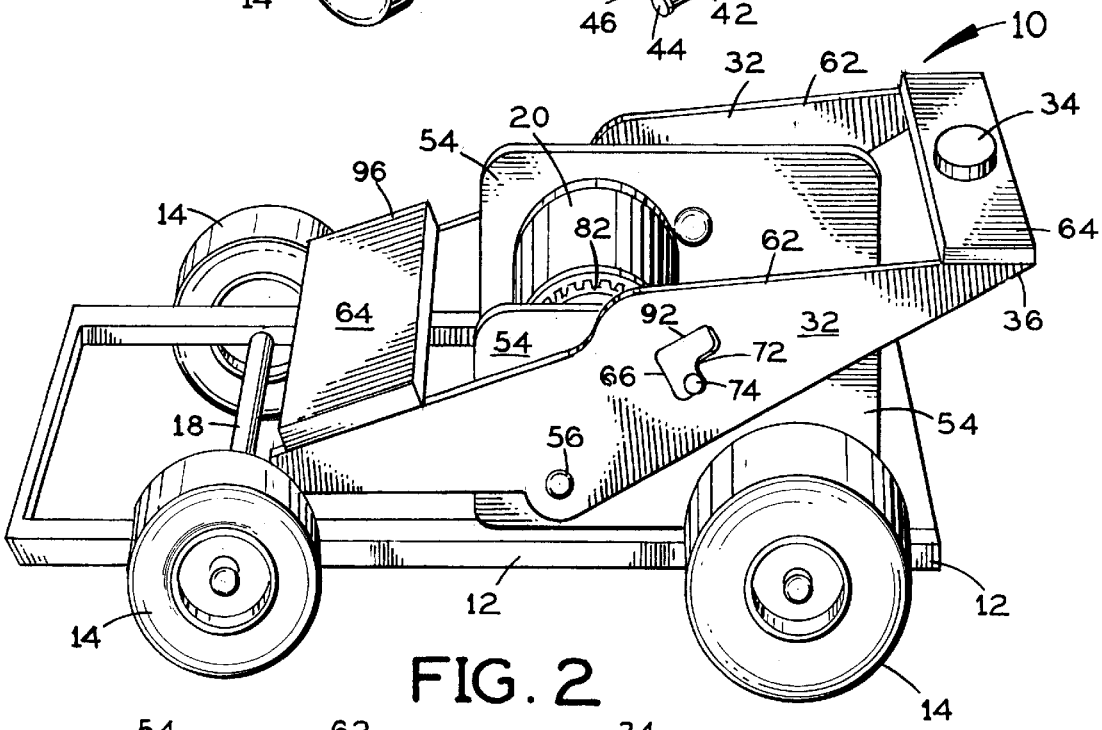
FIG. 2 is a perspective side view of the apparatus of FIG. 1, with the apparatus body removed to reveal the motor and locking lever structure.
Figure 3:
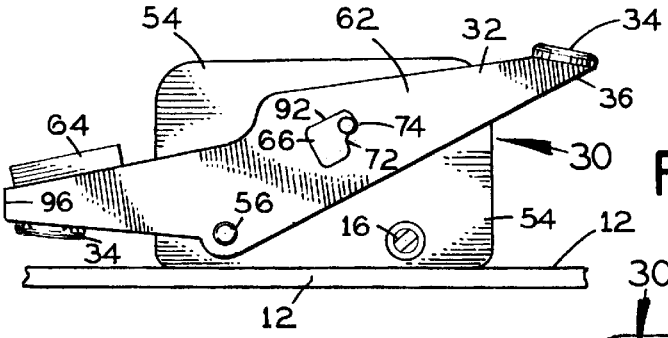
FIG. 3 is a side plan view of the fulcrum structure and lever structure, with the pawl shown in the tripped position for motor actuation.
Figure 4:
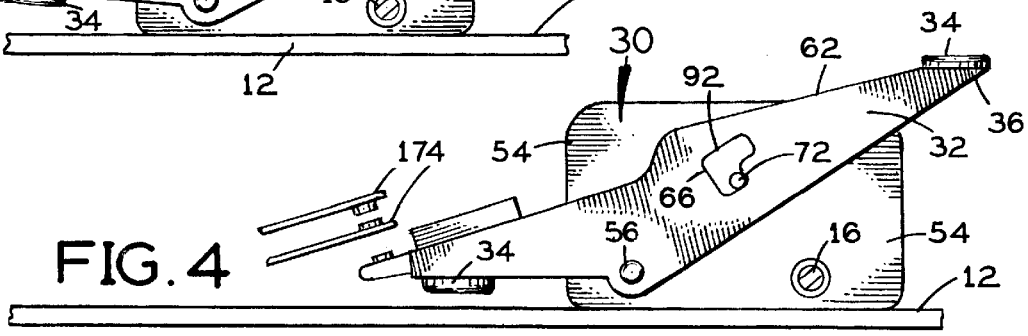
FIG. 4 is a view as in FIG. 3 showing the pawl in the motor locking position.
Figure 5:
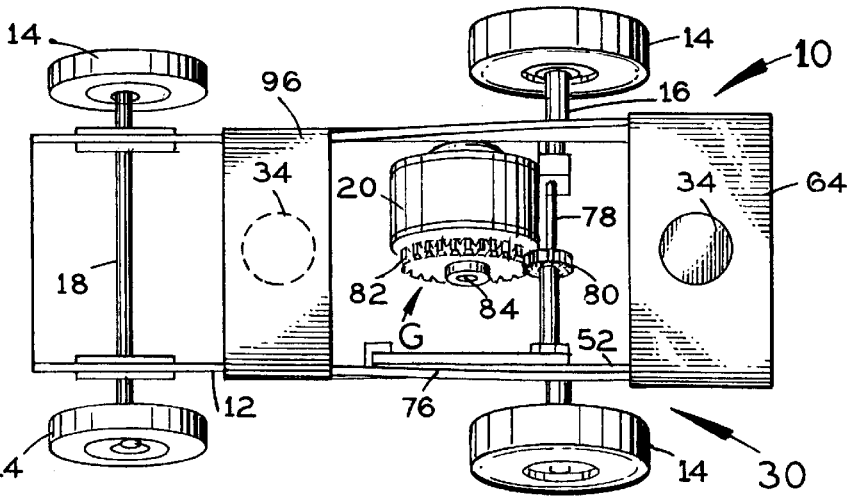
FIG. 5 is a perspective top view of the apparatus of FIG. 2, revealing more of the motor gear structure.
Figure 7:
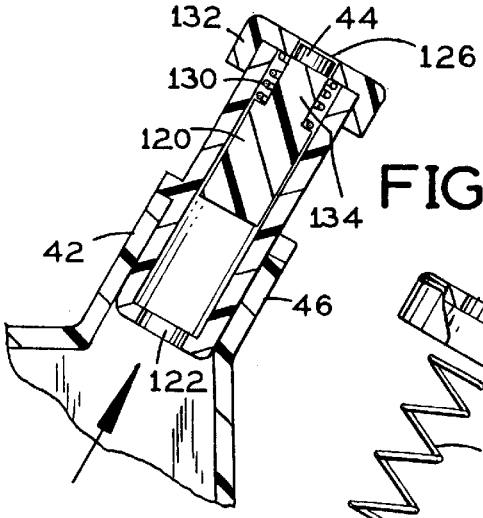
FIG. 7 is a broken-away view of the gasoline can spout of FIG. 6 showing the plunger in the extended position ready to repel the lever magnet, compressing the plunger biasing spring.
Figure 8:
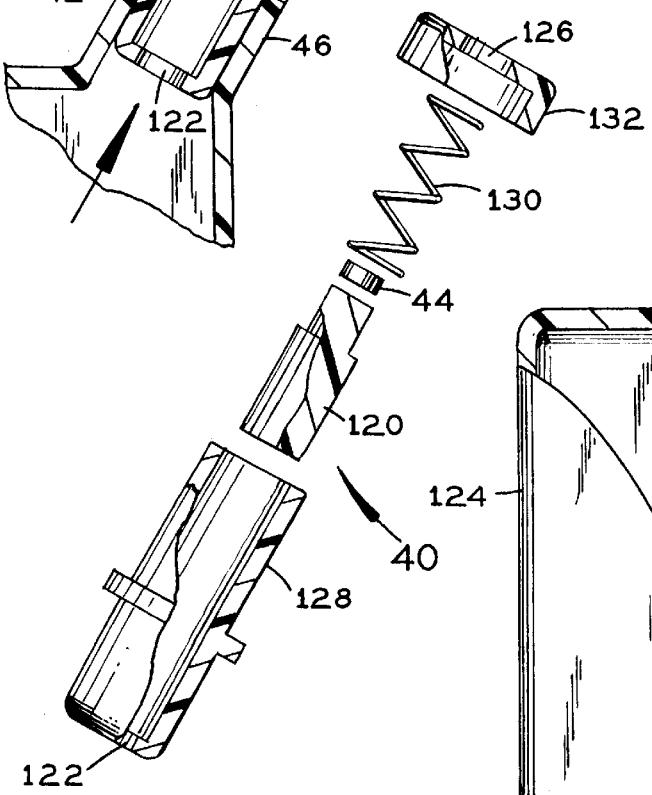
FIG. 8 is an exploded, perspective top view of the various parts making up the gasoline can of FIG. 6.
Figure 6:
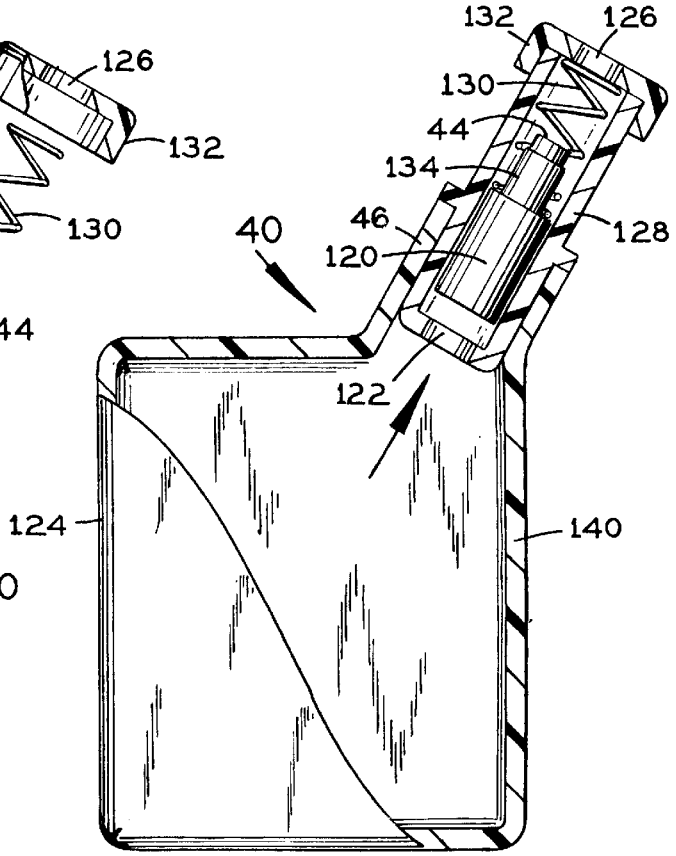
FIG. 6 is a cross-sectional side view of the preferred gasoline can having the actuating magnet on a spring-biased plunger so that squeezing the body of the can forces the plunger to the spout free end from which position it is capable of repelling the lever magnet. The plunger is shown in the retracted, rest position.
Figure 9:
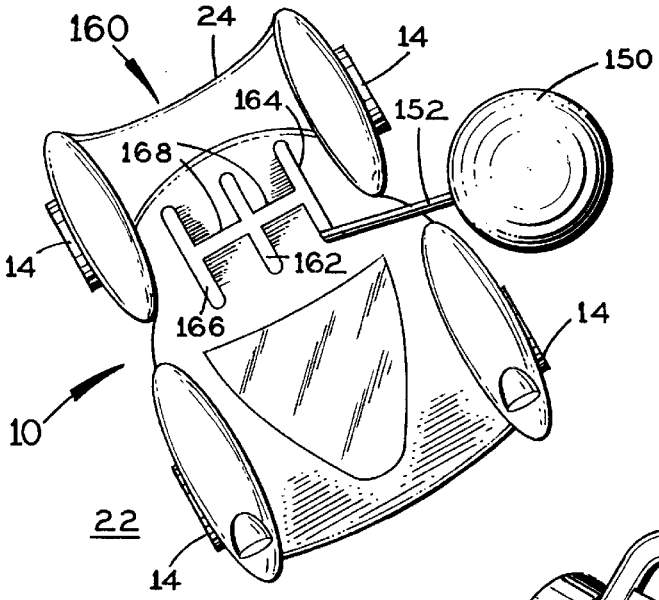
FIG. 9 is a perspective top view of the weighted gear shift ball version of the apparatus. It is noted that the weighted ball feature can also be incorporated into the character versions.
Figure 10:
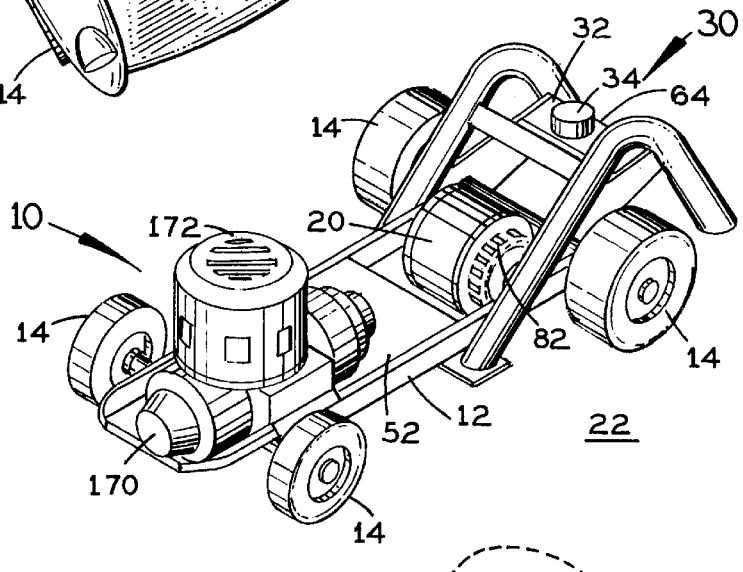
FIG. 10 is a perspective view of the apparatus of FIG. 1, where the apparatus body is omitted and the optional sound circuit and sound box feature is added.
Figure 11:
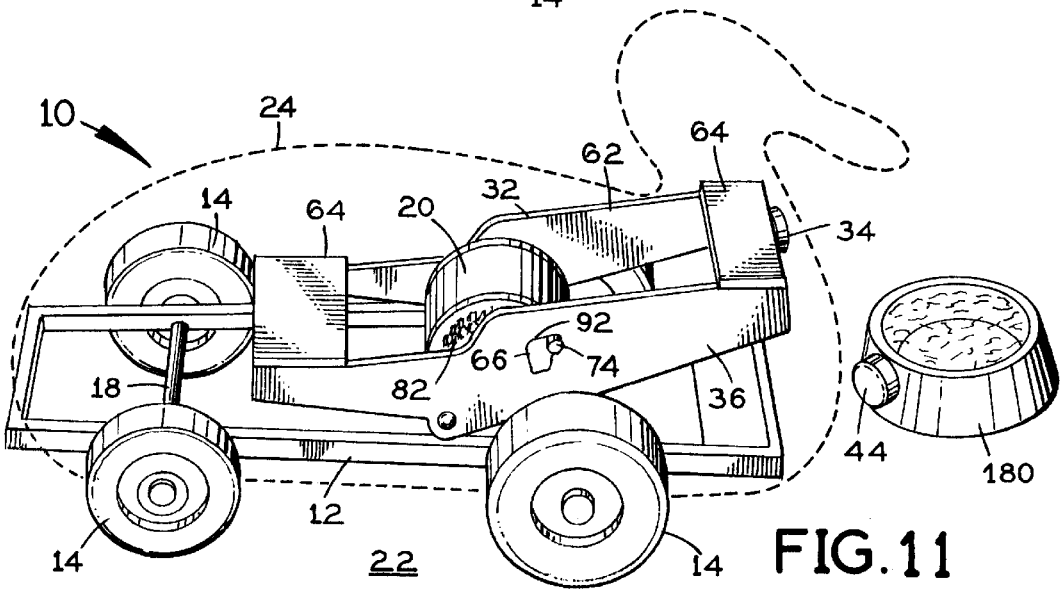
FIG. 11 is a perspective view of an animal character version of the apparatus, with the apparatus body shown in broken lines, and the preferred feeding bowl with actuating magnet. The body configuration is the only essential difference from FIG. 1.

Referring to FIGS. 1–11, a stylized miniature entertainment apparatus 10 is disclosed in the form of a vehicle or character including a chassis 12 with front and rear pairs of support wheels 14, these wheel pairs being interconnected by front and rear wheel axles 18 and 16, respectively. See FIGS. 1 and 2. A back-wind spring powered motor 20 of conventional design is mounted on chassis 12 and drivably connected to rear axle 16. A hollow apparatus body 24 preferably fits over and conceals motor 20 and locking mechanism 30, and is secured to chassis 12. A locking mechanism 30 retains motor 20 in a wound condition and actuates motor 20 at a selected time to rotate rear axle 16 and thus rear support wheels 14 and thereby accelerate apparatus 10 across a support surface 22, such as a table or floor.

Locking mechanism 30 includes a motor trip lever structure 32 with a lever magnet 34 on a first lever structure end 36 and includes a separate motor actuating magnet 44. Locking mechanism 30 is operated by placing actuating magnet 44 near the first lever structure end 36 such that the field of actuating magnet 44 repels the field of lever magnet 34 and pivots first lever structure end 36 away from actuating magnet 44 to actuate motor 20. Actuating and lever magnets 44 and 34, respectively, are oriented relative to each other such that either two magnetic north poles oppose each other or two magnetic south poles oppose each other.

Lever structure 32 is preferably mounted on a fulcrum structure 52 secured to the chassis 12. Lever structure 32 has a lever side portion 62 on each lateral side of motor 20 and of fulcrum structure 52, interconnected at lever structure ends 36 by end struts 64. See FIGS. 3 and 4. A first lever magnet 34 is secured to a first end strut 64, and a second lever magnet 34 is preferably connected to an end strut 64 at a second lever structure end 96. A lever axle 56 extends through both lever side portions 62 and through both fulcrum flanges 54, beneath motor 20. A cam port 66 is provided in one of the lever side portions 62, having a cam edge 72.

Motor 20 is preferably a standard type manufactured in Hong Kong, and perhaps elsewhere, which includes a free swinging arm 76 mounted laterally on a free floating end of a swing gear axle 78 on which a free floating swing gear 80 is mounted. See FIG. 5. Swing gear 80 is connected through other stock motor gears G to apparatus rear axle 16. The manufacturer provides arm 76 stock in motors 20 so that the radially swinging mass of arm 76 holds free floating swing gear 80 in engagement with a motor winding gear 82 on a motor spring axle 84 to wind the spring when apparatus 10 is rolled backward, and so that swing gear 80 then swings out of contact with winding gear 82 to permit spring release through apparatus rear axle 16. These standard motor 20 features will not be explained here in detail because they are already known in the art in connection with these particular pre-existing motors 20. In developing the present invention, it was observed that holding swing gear 80 in interlocking contact with winding gear 82 prevents the motor 20 spring from unwinding and accelerating apparatus 10.

With this in mind, the present invention provides a bore in swing arm 76 into which a pawl 74 snugly fits. Pawl 74 extends out of motor 20 parallel to swing axle 78, perpendicular to swing arm 76, through cam port 66 to ride along cam edge 72. The position of swing gear 80 is therefore controlled by the position of pawl 74. When pawl 74 is laterally pivoted in one direction it moves swing gear 80 into engaging contact with winding gear 82 to prevent motor spring unwinding, and when pivoted in another direction it separates gears 80 and 82 so that the motor 20 spring unwinds, spins rear axle 16 and rear support wheels 14 and accelerates apparatus 10.

Pivoting the lever structure 32 in a release direction, in which lever magnet 34 moves away from actuating magnet 44, causes the cam edge 72 to move relative to the pawl 74 and to present a cam edge notch 92 into which pawl 74 rides and pivots to thereby separate the interlocked gears 80 and 82. Pivoting lever structure 32 in the other direction, causes the pawl 74 to ride out of notch 92 and onto a higher segment of cam edge 72 and to pivot the swing gear axle to place gears 80 and 82 into interlocking contact. Lever structure 32 is preferably pivoted in the locking direction by a greater lever structure weight on a second lever structure end 96 on the opposite side of lever axle 56 from first lever structure end 36. Alternatively, a button (not shown) is provided on second lever structure end 96 for the user to press to pivot lever structure 32 in the release direction following actuation of motor 20 and unwinding of the motor 20 spring.

Automobile Embodiments

Where apparatus 10 is a miniature automobile, a miniature gasoline can 40 with a pouring spout 42 is provided and the motor actuating magnet 44 is secured to the spout free end 46. Lever magnet 34 is preferably located on the apparatus 10 adjacent the conventional location of a gasoline cap, so that moving the actuating magnet 44 progressively nearer lever magnet 34 to actuate motor 20 creates the illusion for a brief moment of pouring gasoline into apparatus 10 to power its subsequent acceleration.

First lever end strut 64 is preferably located within the apparatus body 24 just over a representation of a rear bumper 98 and the lever magnet 34 is secured at the middle of strut 64, immediately behind a representation of a gasoline cap 102 on the body 24. The cap 102 section of body 24 is optionally formed of semi-transparent or highly translucent material to reveal a colored decal 104 on first lever structure end 36 displaying the word "FULL". The lever structure end 36 is positioned to display this decal 104 when the motor 20 spring is wound, and so actually signals the user that the apparatus 10 is powered for use. Pivoting lever structure 32 to actuate the spring motor 20 causes the decal 104 to disappear from view behind a non-transparent region of the body 24. The second lever strut 64 is preferably located just above the chassis 12 and a marker window (not shown) is provided in chassis 12 to show the location of an optional second lever magnet 34 for triggering motor 20.

Actuating lever structure 32 is optionally connected with linkages (not shown) to pivoting or sliding throttle plates 110 on a blower, fuel injector or hood scoop 116. See FIG. 1. Pivoting the lever structure 32 in the release direction to actuate spring motor 20 simultaneously opens plates 110, while pivoting lever structure 32 in the locking direction closes plates 110.

An alternative motor actuating gasoline can 40 and magnet design is contemplated including a plunger 120, having an attached plunger magnet 44 for actuating motor 20, which is sealingly and slidably retained within a tubular spout insert structure 128 sealing and securely affixed within spout 42. See FIGS. 6–8. Insert structure 128 has a first air-passing opening 122 at the base of spout 42 causing spout 42 to be in fluid communication with the main body 124 of the can 40. A second air passing opening 126 at the insert structure 128 free end is further provided to release and admit air through spout 42 as plunger 120 slides within insert structure 128 to equalize pressure within the insert structure 128 free end. A coil spring 130 is provided within insert structure 128 between plunger 120 and the insert structure 128 free end, which resiliently bears against plunger 120 and against an annular spout flange cap 132 at spout free end 46. The magnet end 134 of plunger 120 is preferably of narrower diameter than the remainder of plunger 120 so that the plunger magnet end 134 and plunger magnet 44 fit through annular spout flange cap 132. The side walls 140 of the can 40 main body 124 are flexible, so that squeezing can 40 main body 124 increases can 40 internal air or other fluid pressure and drives plunger 120 and plunger magnet 44 toward the insert structure 128 free end.

To use this version of can 40, the user places spout free end 46 close to one of the lever magnets 34 and then squeezes the can main body 124, advancing plunger magnet 44 to spout free end 46. The advancement of plunger magnet 44 to spout free end 46 brings its magnetic field close enough to the lever magnet 34 magnetic field to repel the lever magnet 34, pivot the lever structure 32 and thereby actuate spring motor 20.

An optional feature of apparatus 10 is a direction-biasing weight taking the form of a disproportionately large gear shift ball 150 on a gear shift lever 152 extending through a slot pattern 160 in the apparatus body 24 roof. See FIG. 9. The gear shift ball 150 controls the apparatus 10 rolling direction and attitude, rather than a transmission gear train.

Roof slot pattern 160 substantially duplicates the interconnected slots in a gear shift console on an actual automobile along which the shift lever travels during transmission operation. Slot pattern 160 includes a longitudinal center slot 162 and parallel left and right slots 164 and 166, respectively, all interconnected by a lateral slot 168. Pushing shift lever 152 to the front end of center slot 162 causes apparatus 10 to accelerate straight forwardly because this action places the weight of ball 150 over the longitudinal center of apparatus 10 and primarily onto the front support wheels 14. The placement of ball 150 over front support wheels 14 prevents execution of a wheel stand during apparatus 10 acceleration. Pushing the lever 152 to the rear end of center slot 162 places the ball 150 weight over the longitudinal center of apparatus 10 and over or behind the rear support wheels 14, causing apparatus 10 to accelerate straight forwardly while tilting backwardly to execute a wheel stand.

Pushing shift lever 152 to the front end of right slot 166 shifts the ball 150 weight to the right side of apparatus 10 and primarily onto forward support wheels 14, so that apparatus 10 turns to the right as it accelerates forwardly with no wheel stand. Pushing shift lever 152 to the rear end of the right slot 166 places the ball 150 weight over the longitudinal center of apparatus 10 and over or behind apparatus 10 rear support wheels 14, causing apparatus 10 to turn to the right as it accelerates forwardly and at the same time to rise into a wheel stand. Pushing lever 152 to the forward end of left slot 164 shifts the ball 150 mass to the left side of apparatus 10, and primarily onto forward support wheels 14, so that apparatus 10 turns to the left as it accelerates with no wheel stand. Pushing lever 152 to the rear end of left slot 164 causes apparatus 10 to turn to the left as it accelerates and at the same time to rise into a wheel stand.

Positioning shift lever 152 within left slot 164 or within right slot 166 turns apparatus 10 during acceleration because it shifts the center of gravity of apparatus 10 to one side of the wheel base and the mass of ball 150 resists the change in speed and momentum. The ball 150 momentum resistance or drag on this given side biases apparatus 10 so that the side on which ball 150 is positioned accelerates more slowly than the other side of apparatus 10, causing apparatus 10 to turn to the ball 150 side during acceleration. A similar but opposite effect takes place during apparatus 10 deceleration. As apparatus 10 decelerates, the mass of ball 150 causes it to once again resist the change in speed and its momentum causes the ball 150 side of apparatus 10 to decelerate more slowly than the other side of apparatus 10, causing apparatus 10 to turn in the opposite direction during deceleration. Thus apparatus 10 travels a path with approximately an S-shape.

With this in mind, the user can wind and then position several of the apparatus 10 embodiments having ball 150 to produce a choreographed effect when actuated to accelerate at the same time. They may, for example, roll around and between each other.

Still another feature of the invention is a sound generating mechanism 170 simulating the sound of a revving race car engine. Sound generating mechanism 170 is preferably activated by pivoting the lever structure 32 in the release direction to actuate the motor 20 and connected two electrical contacts 174 controlling mechanism 170, and deactivated by pivoting the lever structure 32 in the locking direction to lock the motor 20. Sound generating mechanism 170 is preferably a drop-in sound circuit, including a stock integrated circuit, and a stock hollow cylindrical sound box 172 for amplification. A preferred stock circuit is the same one incorporated into the VOICE MEMO KEY CHAIN™, RADIO SHACK™ catalog number 63-941. See FIG. 10. The revving sounds of an actual race car engine are recorded into the sound circuit for a convincing effect.

Sound box 172 is preferably large and conspicuous on apparatus 10, its appearance becoming part of apparatus 10 stylizing which has no direct correlation with any part of an actual automobile. Apparatus 10 is on one hand clearly supposed to be a representation of a full scale automobile, but on the other hand has parts suggesting an intriguing operative mechanism in its own right, capturing the curiosity and imagination of the observer, and fascinating inquisitive children.

Character Embodiments

Miniature characters such as people and animals with reverse drive motors 20, chassis 12 with support wheels 14, appropriately configured body 24 and the same locking mechanism 30 are also contemplated. Lever magnet 34 is positioned adjacent to the mouth of the character body 24 and the actuating magnet 44 is placed on a miniature feeding bowl 180 or bottle instead. See FIG. 11.

Other Variations

It is alternatively contemplated, although less preferred, that the actuating magnet 44 pivot lever structure by attracting, rather than repelling, lever magnet 34. The repelling construction is preferred partly because apparatus 10 is driven away from actuating magnet 44 to enhance acceleration following motor 20 actuation. Furthermore, the user is able to develop a skill in placement of the actuating magnet 44 relative to the lever magnet 34 to maximize acceleration gains from magnetic repulsion. Ramps and tracks are optionally provided for containing and guiding apparatus 10 during acceleration which contain actuating magnets 44 positioned to trigger lever magnet 34 on the second end of pivot structure 32 from underneath apparatus 10. The actuating magnet 44 is optionally secured to a lever structure (not shown) in the track for pivoting actuating magnet close to the lever magnet 34 to repel lever magnet 34 and actuate motor 20.

While the invention has been described, disclosed, illustrated and shown in various terms or certain embodiments or modifications which it has assumed in practice, the scope of the invention is not intended to be, nor should it be deemed to be, limited thereby and such other modifications or embodiments as may be suggested by the teachings herein are particularly reserved especially as they fall within the breadth and scope of the claims here appended.

I claim as my invention:

1. An entertainment apparatus, comprising:

a chassis, an apparatus body having the configuration of a miniaturized automobile, including a forward engine compartment with a hood, a passenger cab portion and a rearward trunk portion, support wheels rotatably secured to said chassis, a back-wind spring powered motor mounted to said chassis and drivably connected to at least one said support wheel, such that said motor is wound by rolling said chassis backward on said support wheels, and a locking mechanism including means for releasibly locking said motor against unwinding and means for releasing said motor to deliver torque to and thereby rotate said at least one support wheel and accelerate said apparatus across a support surface, said locking mechanism comprising a fulcrum structure secured to said chassis and having a fulcrum pivot connection member, a lever structure pivotally connected to said pivot connection member and having a lever magnet secured to said lever structure a certain distance from said fulcrum pivot connection member, and said lever structure being connected to said locking mechanism such that pivoting said lever structure on said fulcrum pivot connection member in a first direction causes said motor locking mechanism to release and thereby actuate said motor, and pivoting said lever structure on said fulcrum pivot connection member in a second direction causes said motor locking mechanism to lock said motor against actuation, and an actuating magnet to be hand oriented by a user relative to said lever magnet such that the field of said actuating magnet repels the field of said lever magnet and thereby pivots said lever structure in said first direction to actuate said motor when placed in close proximity to said lever magnet by the user, wherein said lever magnet is located on said lever structure, and an actuating magnet handle having the configuration of a miniature gasoline can with a can spout, wherein said actuating magnet is supported by said spout, such that moving said spout of said miniature gasoline can progressively nearer said lever structure pivots said lever structure and causes the field of said actuating magnet to repel the field of said lever magnet and thereby pivots said lever structure substantially downwardly and away from said apparatus body and actuates said motor to create the illusion of pouring gasoline into said apparatus to power subsequent acceleration of said apparatus, wherein said gasoline can comprises a gasoline can body and wherein said gasoline can body comprises flexible walls for squeezing by a user, and wherein said gasoline spout is hollow and in fluid communication with said gasoline can body through a spout connected end and is in fluid communication with the atmosphere through a spout free end, said gasoline can additionally comprising a plunger, wherein said actuating magnet is attached to said plunger and wherein said plunger is sealingly and slidably retained within said spout, said gasoline can further comprising a coil spring within said spout between said plunger and said spout free end and an inwardly extending annular spout flange at said spout free end, such that said coil spring resiliently bears against said plunger and said annular spout flange and such that squeezing said can body increases can internal fluid pressure and drives said plunger and plunger magnet toward said spout free end to expose the magnetic field of said plunger magnet to repel said lever magnet, pivot said lever structure and actuate said motor.

2. An entertainment apparatus, comprising:

a chassis, support wheels rotatably secured to said chassis, a back-wind spring powered motor mounted to said chassis and drivably connected to at least one said support wheel, such that said motor is wound by rolling said chassis backward on said support wheels, and a locking mechanism including means for releasibly locking said motor against unwinding and means for releasing said motor to deliver torque to and thereby rotate said at least one support wheel and accelerate said apparatus across a support surface, said locking mechanism comprising a fulcrum structure secured to said chassis and having a fulcrum pivot connection member, a lever structure pivotally connected to said pivot connection member having a lever magnet secured to said lever structure a certain distance from said fulcrum pivot connection member, and said lever structure being connected to said locking mechanism such that pivoting said lever structure on said fulcrum pivot connection member in a first direction causes said motor locking mechanism to release and thereby actuate said motor, and pivoting said lever structure on said fulcrum pivot connection member in a second direction causes said motor locking mechanism to lock said motor against actuation, and an actuating magnet to be hand oriented by a user relative to said lever magnet such that the field of said actuating magnet repels the field of said lever magnet and thereby pivots said lever structure in said first direction to actuate said motor when placed in close proximity to said lever magnet by the user, a shift lever having a shift lever connected end portion pivotally secured to said apparatus and a shift lever free end portion, and a direction biasing weight member having a mass secured to said shift lever free end portion, wherein said support wheels comprise front wheels and rear wheels, additionally comprising an apparatus body having a body roof and a slot pattern in said body roof, said slot pattern comprising a longitudinal center slot and parallel left and right slots, all interconnected by a lateral slot, such that pushing said shift lever to the front end of said center slot and thereby directs acceleration of said apparatus in a straight forwardly direction by it placing the mass of said weight member over the longitudinal center of said apparatus and onto the front said support wheels, and placement of said weight member over the front said support wheels prevents a wheel stand, and pushing said shift lever to the rear end of said center slot places the mass of said weight member over the longitudinal center of said apparatus and over said apparatus rear said support wheels, and thereby directs acceleration of said apparatus in a straight forwardly direction while tilting backwardly to produce a wheel stand, and such that pushing said shift lever to the front end of said right slot shifts the mass of said weight member to the right side of said apparatus and onto the forward said support wheels, such that said apparatus turns to the right as it accelerates forwardly with no wheel stand, and pushing said shift lever to the rear end of said right slot places the mass of said weight member over the longitudinal center of said apparatus and over said apparatus rear said support wheels, causing said apparatus to turn to the right as it accelerates forwardly and at the same time to rise into a wheel stand, and pushing said shift lever to the forward end of said left slot shifts the mass of said weight member to the left side of said apparatus, and onto the forward said support wheels, such that said apparatus turns to the left as it accelerates with no wheel stand, and pushing said shift lever to the rear end of said left slot causes said apparatus to turn to the left as it accelerates and at the same time to rise into a wheel stand.

* * * * *